US007494018B2

(12) United States Patent
Wu

(10) Patent No.: US 7,494,018 B2
(45) Date of Patent: Feb. 24, 2009

(54) DISPLAY BRACKETS FOR A WRENCH

(75) Inventor: Arthur Wu, Taichung Hsien (TW)

(73) Assignee: Proxene Tools Co., Ltd., Taichung (TW)

( * ) Notice: Subject to any disclaimer, the term of this patent is extended or adjusted under 35 U.S.C. 154(b) by 491 days.

(21) Appl. No.: 11/175,354

(22) Filed: Jul. 5, 2005

(65) Prior Publication Data

US 2007/0007156 A1 Jan. 11, 2007

(51) Int. Cl.
*A47F 7/00* (2006.01)

(52) U.S. Cl. ..... 211/70.6

(58) Field of Classification Search ..... 211/70.6, 211/60.1, 85.26; 206/349, 372, 376, 375, 206/229, 576, 320
See application file for complete search history.

(56) References Cited

U.S. PATENT DOCUMENTS

RE37,129 E * 4/2001 Chow ..... 206/349
6,375,005 B1 * 4/2002 McCann ..... 206/349
6,409,015 B1 * 6/2002 Hu ..... 206/378
6,464,840 B1 * 10/2002 McCann ..... 206/349
6,637,606 B1 * 10/2003 Chen ..... 211/70.6
6,719,154 B2 * 4/2004 Kao ..... 211/70.6
6,820,742 B1 * 11/2004 Chen ..... 206/378
6,935,516 B2 * 8/2005 Chiang ..... 211/70.6

* cited by examiner

*Primary Examiner*—Sarah Purol
(74) *Attorney, Agent, or Firm*—Banger Shia

(57) ABSTRACT

A display bracket for a wrench that achieves the purpose of economizing exhibition space comprises a locking hole capable receiving a cylindrical connecting member of a mount of and a main body further consisting of a flexible piece near the locking hole, whereby the main body will connected to the mount by a plurality of arced projection around the connecting member. The connecting member can further secured with the maim body by the engagement between a ratchet on the outer rim thereon and the flexible piece. Thereby, the wrench can be hung on the display bracket for exhibition.

17 Claims, 11 Drawing Sheets

DISPLAY BRACKETS FOR A WRENCH

FIELD OF THE INVENTION

The present invention relates to display brackets for a wrench, more particularly to a display bracket for a wrench that achieves the purpose of economizing exhibition space and has a simple structure.

BACKGROUND OF THE INVENTION

A display bracket for a wrench of the prior art, such as the "display bracket for a wrench with flexibility damping" disclosed by Taiwan patent number 541922, is characterized by a flexible part attached to a hexagonal mount and a locking hole on a display plate. The flexible part provides a resistant torque when a wrench connected to the mount is rotating the hexagonal mount, whereby the rotational angle of the mount can be known. However, the conventional display bracket has the disadvantages that the rotational angle of the mount cannot be precisely recognized and that the flexible part is not durable. As the flexible part is experiencing a fatigue, the resistant torque soon disappears.

The "tool bracket" disclosed by Taiwan patent number 434659 comprises a main body having an annularly arranged deflected portion equipped with teeth and a set of annularly arranged teeth on a sound board, whereby the engagement between the deflected portion and the sound board will create a sound indicating the angular displacement of a tool on the main body with respect to the main body.

However, a display bracket using a sound board of the prior art has two sets of teeth each on the sound board and the deflected portion of the main body, which makes the bracket too complicated to build and therefore increases the production cost.

The "wrench display bracket" disclosed by Taiwan patent number 542078 is provided with a hanger post attached onto a planar body at a predetermined location by screwed parts or an adhesive material. The hanger post has a flexible plate extended from the outer rim thereof. The hanger post is further provided with a retaining hole or slot for securing a hexagonal nut, whereby, as the wrench is rotated against the planar body, the engagement of a set of teeth within the nut to the hanger post will produce a repetitious jump feeling and sounds so as to recognizing the rotational angle.

However, the "wrench display bracket" disclosed by Taiwan patent number 542078 has the following disadvantage.

The effects of recognizing angle are produced in a combination of a hanger planar body, a hanger post and a nut. The combination further includes a flexible plate extended from the outer rim of the post, whereby, as the wrench is rotated against the planar body, the engagement between a set of teeth within the nut and the flexible plate of the hanger post will produce a repetitious jump feeling and sounds so as to recognizing the rotational angle. However, the structure is still too complicated.

SUMMARY OF THE INVENTION

Accordingly the primary objective of the present invention is to provide a display bracket for a wrench that can economize exhibition space. The display bracket for a wrench comprises only a main body and a mount. The main body is provided with a through locking hole at a predetermined location thereon. The locking hole further includes a pair of symmetric, parallel slots of predetermined depth in a horizontal direction straddling the locking hole on the main body.

A flexible piece is formed between the symmetric slots. The mount consists of an engaging portion with a polygonal circumference and a cylindrical connecting member. The cylindrical connecting member of the mount is capable of being connected to the locking hole, whereby a plurality of arced projections around the member and the main body can be engaged.

The display bracket for a wrench of the present invention thus has a simpler structure. The angular displacement of the mount with respect to the main body can still be recognized by a repetitious jump feeling and sounds, which are produced by the interaction between an annular ratchet and a flexible piece on a dial on the main body.

The various objects and advantages of the present invention will be more readily understood from the following detailed description when read in conjunction with the appended drawings.

DETAILED DESCRIPTION OF THE PREFERRED EMBODIMENTS

Figure 1:
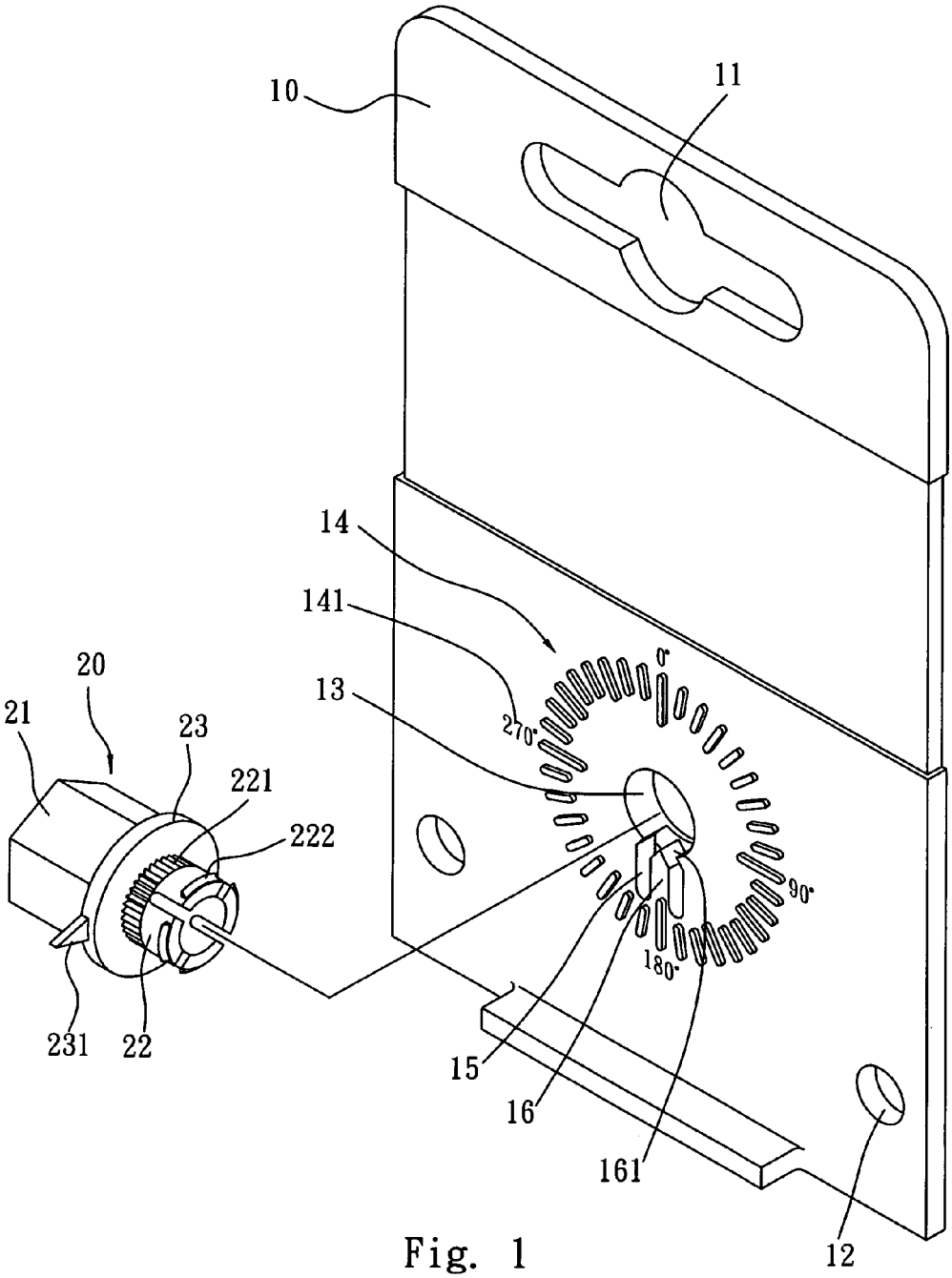
FIG. 1 is an exploded perspective view of a display bracket for a wrench of the present invention.
Figure 2:
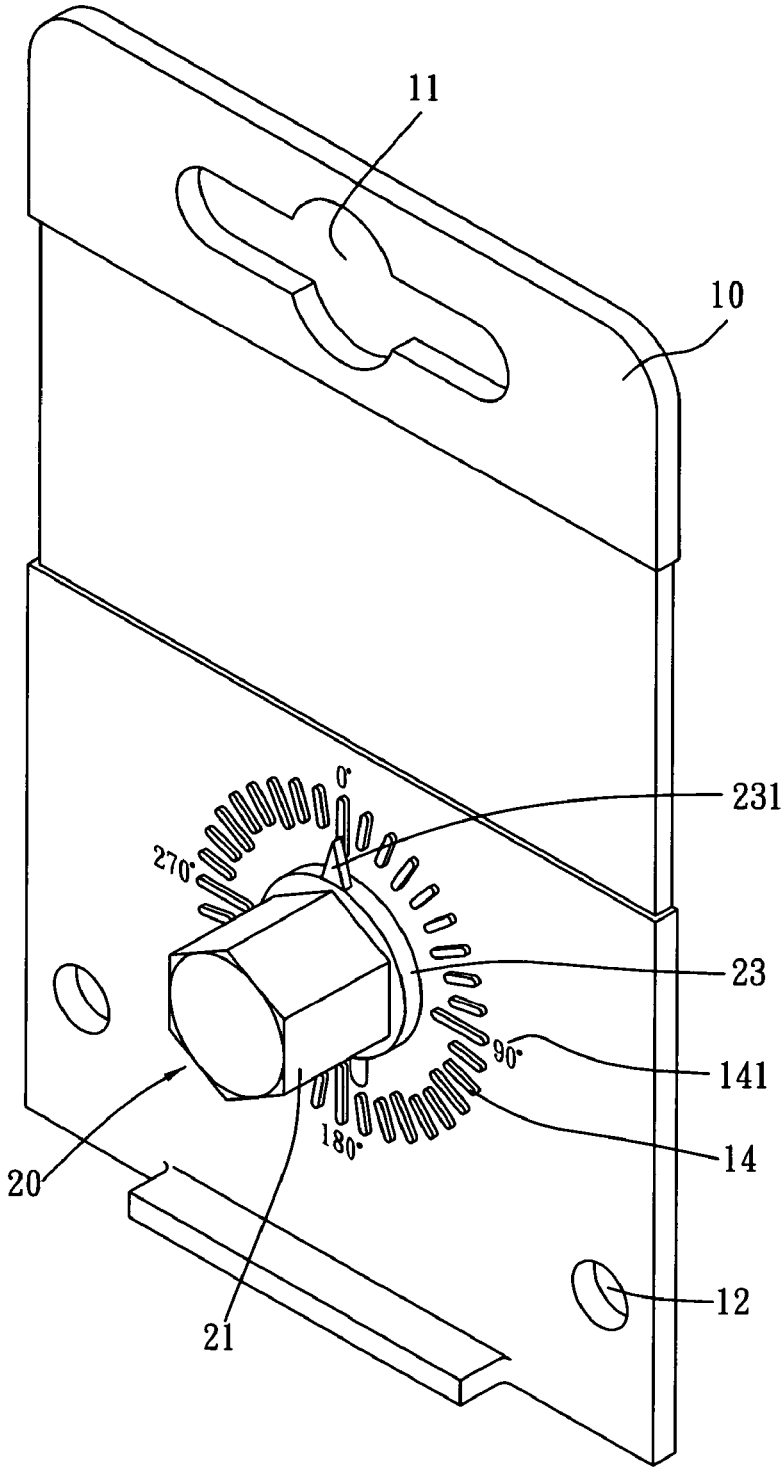
FIG. 2 is a perspective view of the display bracket for a wrench in FIG. 1.
Figure 3:
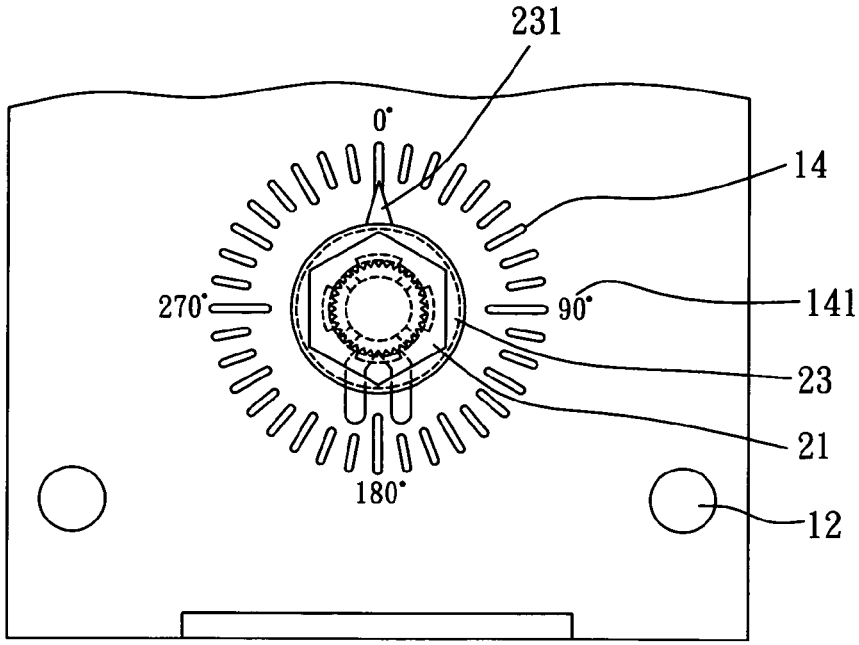
FIG. 3 is a front view of the display bracket for a wrench in FIG. 1.
Figure 3B:
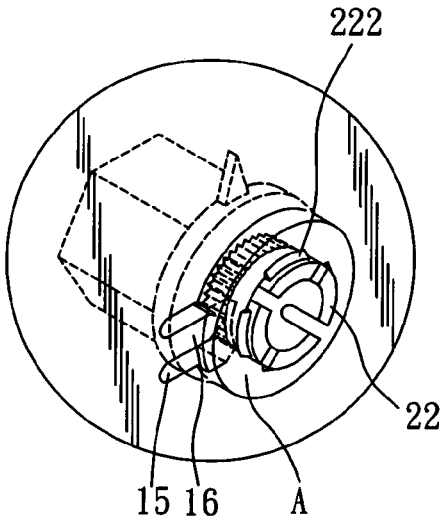
FIG. 3B is a perspective view of a local enlarged transparent portion of the display bracket for a wrench in FIG. 1.
Figure 3A:
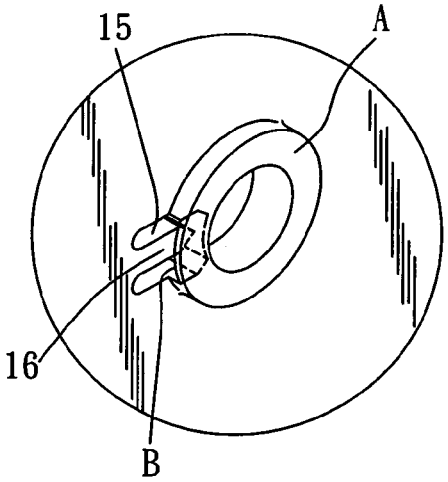
FIG. 3A is a perspective view of a local enlarged portion of the display bracket for a wrench in FIG. 1.
Figure 4:
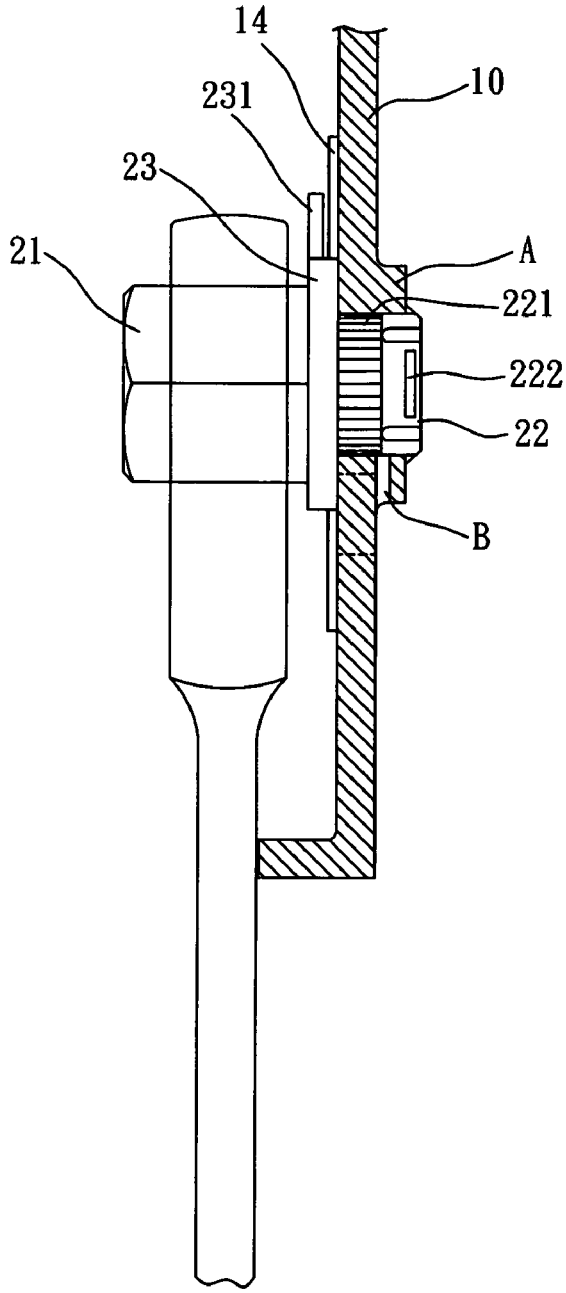
FIG. 4 is a lateral cross-sectional view of the display bracket for a wrench in FIG. 1.
Figure 5:
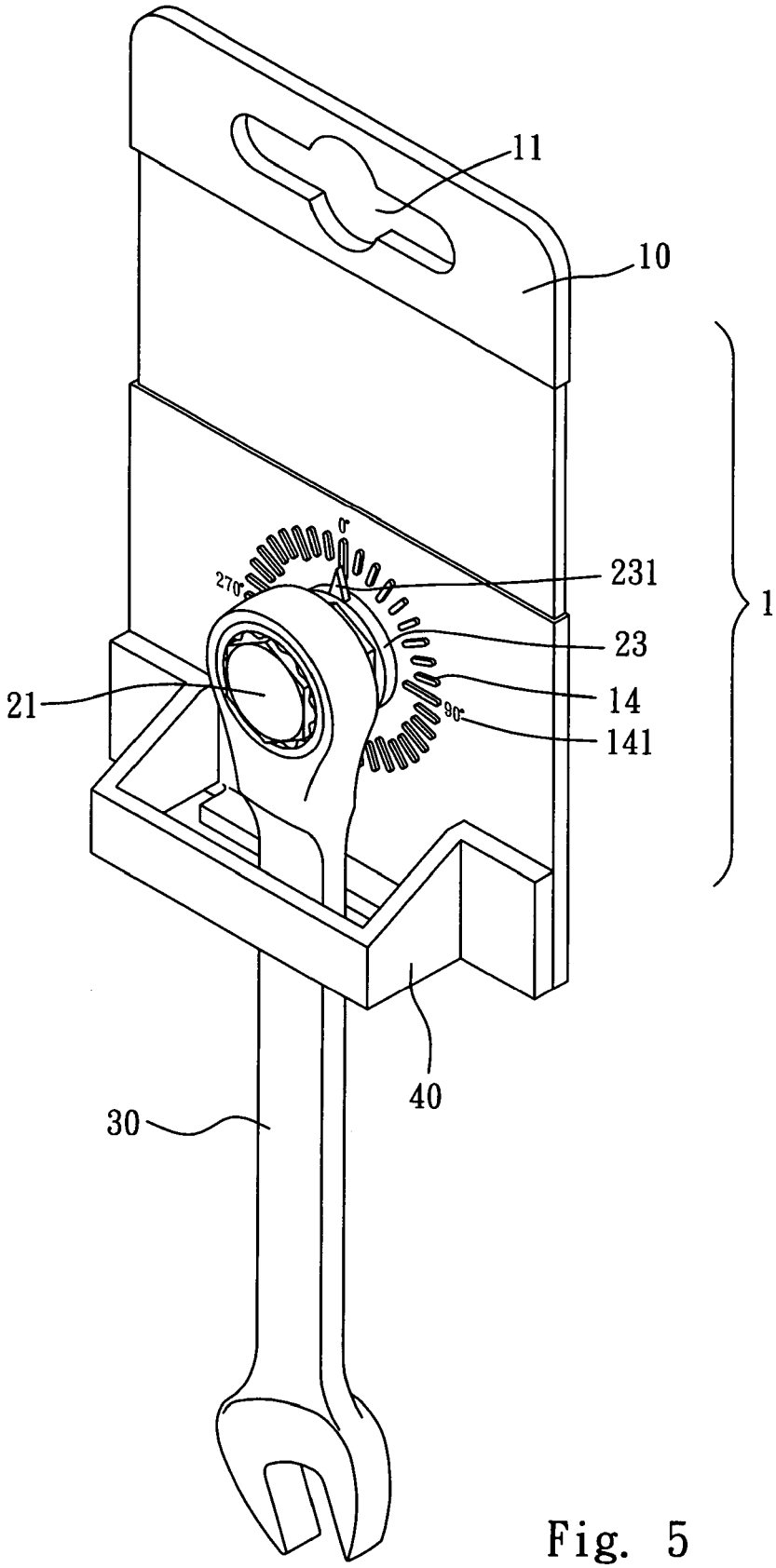
FIG. 5 is a perspective view of the display bracket for a wrench in FIG. 1 wherein a wrench is secured.
Figure 6:
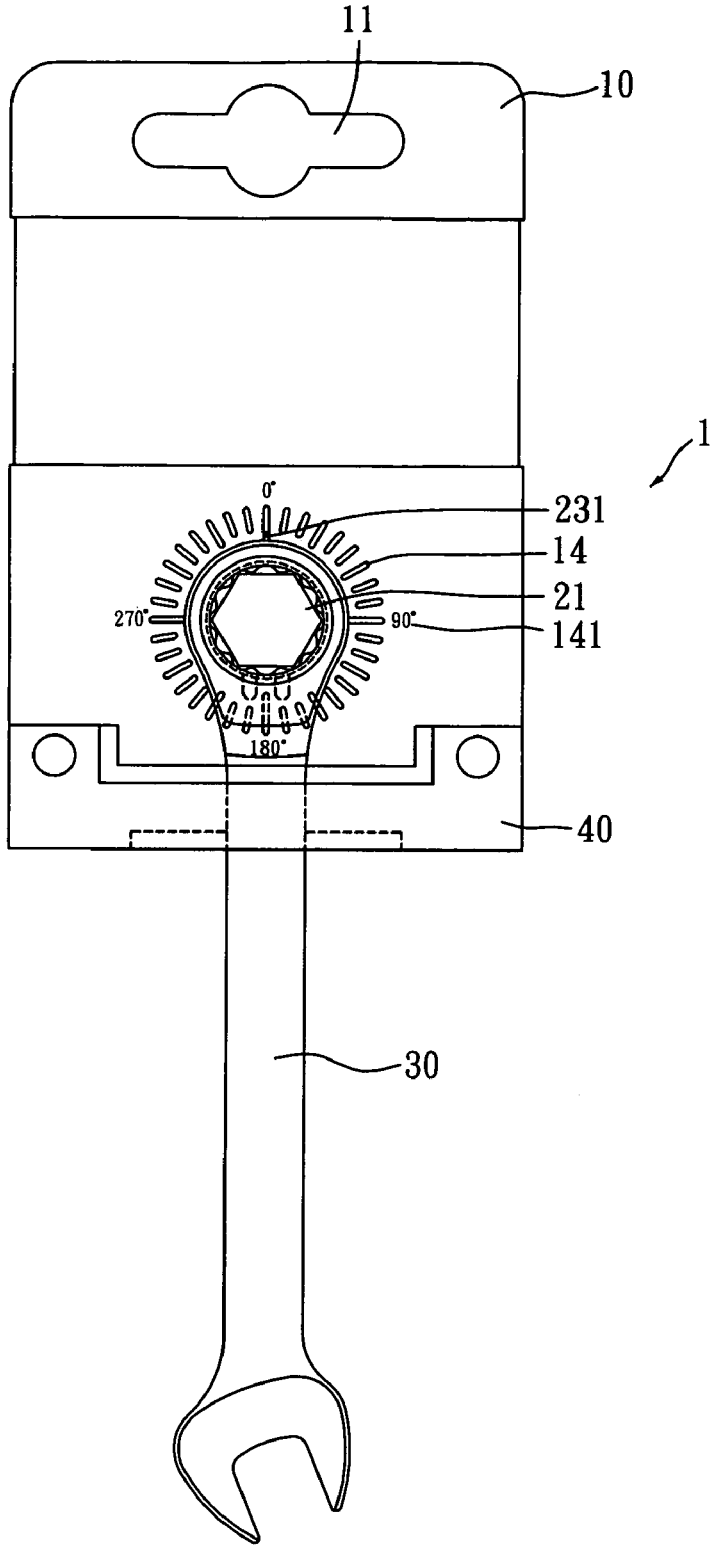
FIG. 6 is a front view of the display bracket for a wrench in FIG. 1 wherein the wrench is still.
Figure 7:
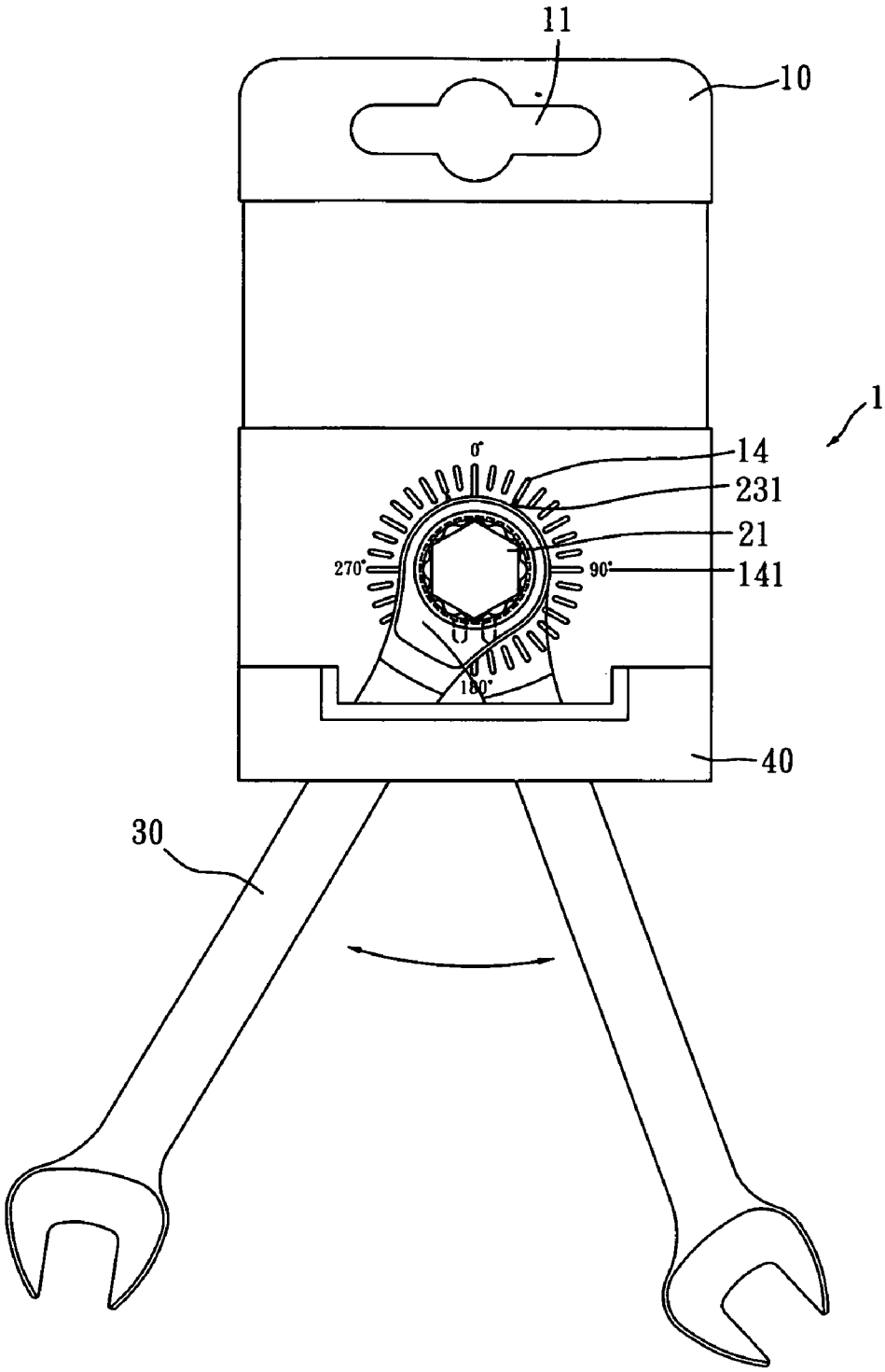
FIG. 7 is a front view of the display bracket for a wrench in FIG. 1 wherein the wrench is being rotated.

Referring to FIGS. 1, 2 and 4, a display bracket for a wrench according to the present invention comprises a main body 10 with a predetermined thickness which is a planar slab having a front side, a rear side and a hanging hole 11. Beneath the hanging hole 11, there are a pair of symmetric, retaining holes 12 for securing as an Ω-shaped retaining plate 40 (as shown in FIG. 5). The locking hole 13 of the main body 10 further includes a locking hole 13 going through the front side and the rear side of the main body 10; the locking hole 13 forms a circular flange 4 on the rear side therearound. The front side of the main body 10 is provided with an indicator ring 14 formed by three types of bulged, elongated projections. The indicator ring 14 is located around the locking hole 13 and forms numeric indicators 141 on the outside rim thereof. The locking hole 13 further includes a pair of symmetric, parallel slots 15 of predetermined depth in a horizontal direction straddling the locking hole 13 on the main body 10. A flexible piece 16 is formed between said symmetric slots. On top of the flexible piece forms a pointed portion 161. Since that the symmetric slots 15 on two side of the flexible piece 16 have a length substantially equal to the thickness between the front side and the rear side and that a notch B is cut on a side of the flange A, as shown in FIG. 3A, the flexible piece 16 becomes an in isolated body on the flange A that can jump when it is urged.

The display bracket for a wrench further comprises a mount 20 capable of being connected to the locking hole 13. The mount consists of an engaging portion 21 with a hexagonal circumference and a cylindrical connecting member 22. The interface between the engaging portion 21 and the connecting member 22 forms a dial 23. There is a triangular pointer 231 located at the outer rim of the dial 23; the pointer 231 will move the rotation of the mount 20.

Further, the hollow, cylindrical connecting member 22 is provided with two perpendicular notches on a bottom side thereof for a flexible compression of the connecting member 22. The end of the connecting member 22 close to the dial 23 is provided with a ratchet 221 composed of a multitude of continuous oblique teeth surrounding the ratchet 221. When the connecting member 22 is inserted into the locking hole 13, the pointed portion 161 of the flexible piece 16 can be engaged with the ratchet 221, thereby the flexible piece 16 will go through a transverse jump across the symmetric slots 15 and will produce a sound by the jump of the pointed portion 161 against the ratchet 221. There are 4 arced projections 222 formed on the outer surface at the rear end of the connecting member 22 of the mount 20 for securing on the flange A when the mount is inserted into the main body.

Referring to FIGS. 1 and 2, to use the present invention, the mount 20 is inserted into the locking hole 13 on a main body 10, which is a very simple structure in contrast to the three-part display bracket of the prior art.

As shown in FIG. 5, the display bracket for a wrench further has the function of preventing theft in an exhibition. In this present invention, beneath the main body 10, there are a pair of retaining holes 11 for securing an Ω-shaped retaining plate 40. Therefore, a wrench displayed on the bracket is hard to steal.

Moreover, the middle bulged section of the retaining plate 40 may provide the ratchet wrench 30 with a left angle pre-setter and a right angle pre-setter so that a range of angular displacement can be set. Referring to FIGS. 3A, 3B, 6 and 7, as the connecting member 22 of the mount 20 is inserted into the locking hole 13, the ratchet 221 on the outer surface of the top end of the connecting member 22 will engage the pointed portion 161 atop the flexible piece 16, as shown in FIG. 3B. Thereby, when a ratchet wrench 30 is rotated in a reciprocated way, the mount 20 rotates accordingly and the ratchet 221 of the mount 20 will urge the flexible piece 16 to jump back and forth, creating a quivering on the hand of a holder. The display bracket further creates a sound corresponding to the jump. The jump and the associated sounds help the user to recognize the angular displacement of the mount with respect to the main body. The angular displacement can be further identified by the indicator ring 14 composed of three sets of small elongated bulged projections of different lengths, as well as a plurality of numeric indicators aside the indicator ring 14. The pointer 231 on one side of the dial 23 indicates the precise rotational angel of the mount 20.

The present invention is characterized by combining the main body 10 and the mount 20 to achieve the function of displaying a wrench. It is another advantage of the present invention that the sounds created as the mount 20 is rotated against the main body 10 help the user to recognize the exact angular displacement. Instead of the conventional design of complicated tooth structures on both of the main body 10 and the mount 20, the ratchet 221 of the connecting member 22 can creates the same rattling audio effect when it is connected to the locking hole 13; this is achieved by the flexible piece 16 formed between the symmetric slots 15. The present invention revolutionizes the old concept of two engaging annular tooth structures on both of the mount and the main body, indeed achieving a structural simplicity.

Figure 8:
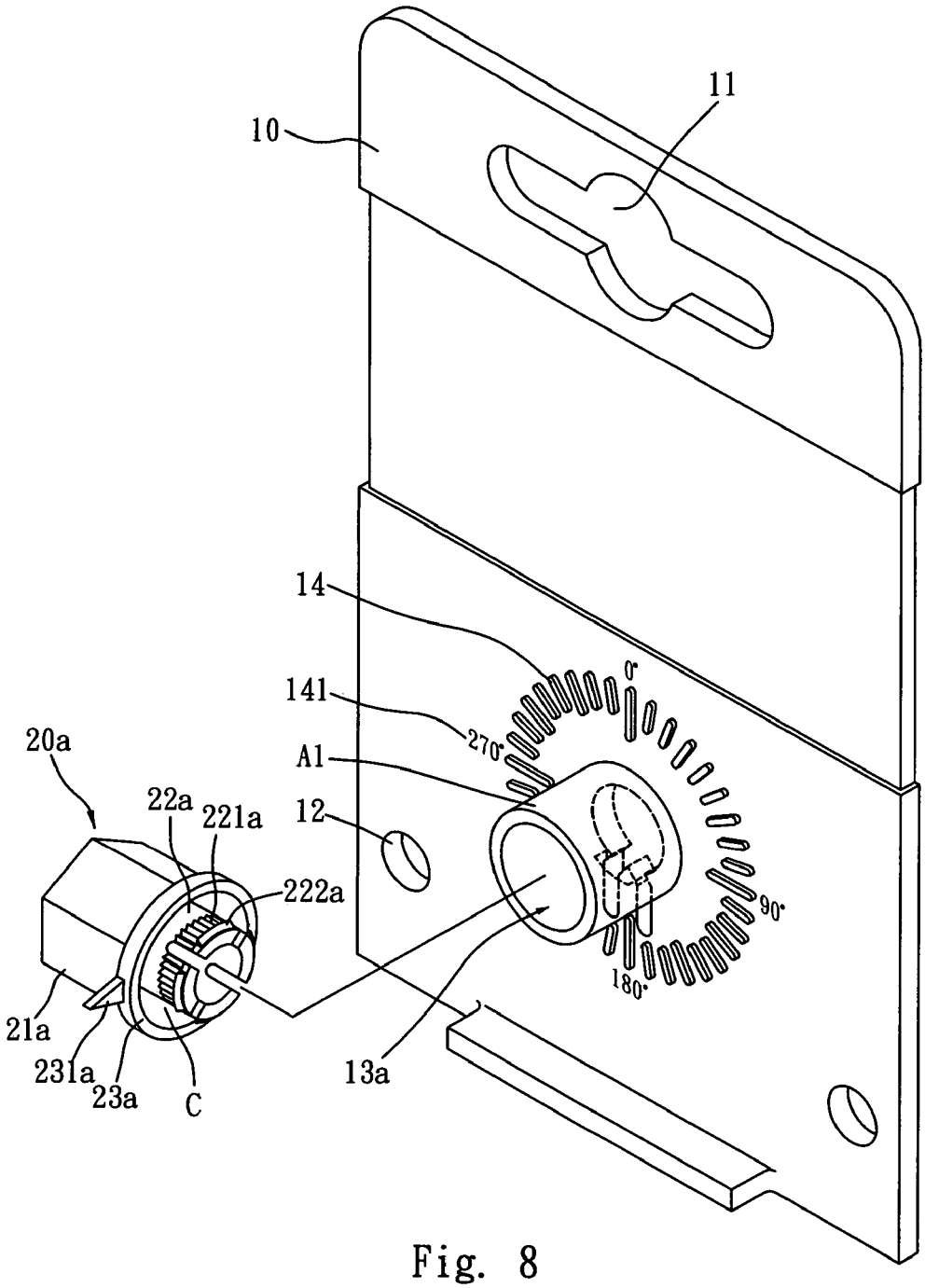
FIG. 8 is an exploded perspective view of the second preferred embodiment of the present invention as a display bracket for a wrench.
Figure 9:
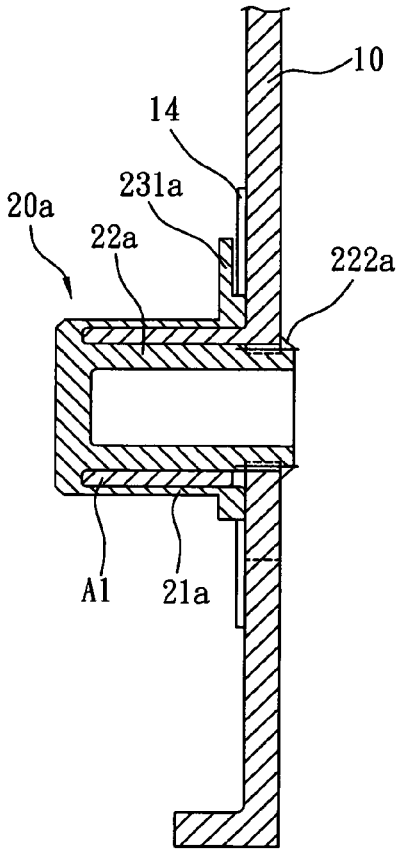
FIG. 9 is a lateral cross-sectional view of the second preferred embodiment in FIG. 8.
Figure 10:
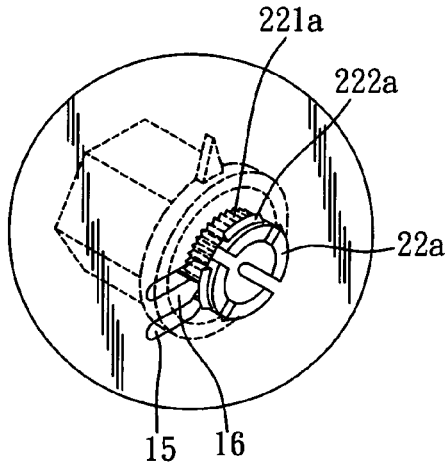
FIG. 10 is a perspective view of a local enlarged portion of the second preferred embodiment in FIG. 8, wherein the mount is engaged with the main body.

Referring to FIGS. 8 to 10, the second preferred embodiment of the present invention as a display bracket for a wrench has similar components to the first preferred embodiment. They differs in a flange A1 vertically extended from the front side of the main body 10, which flange A1 pieces through the main body 10 to form a locking hole 13*a*. Because of the locking hole 13*a*, the flange A1 becomes a hollow tubular body with a predetermined thickness.

Accordingly, the mount 20*a* of the second preferred embodiment comprises an engaging portion 21*a* taking the shape of a hexagonal nut, a cylindrical connecting member 22*a* and a dial 23*a*. The difference of the second preferred embodiment is that the hexagonal engaging portion 21*a* is a hollow body; the dial 23*a* and the pointer 231*a* are outwardly extended from a bottom end of the engaging portion 21*a*. On the other hand, the connecting member 22*a* is formed inside the bottom wall of the engaging portion 21*a*. A portion of the connecting member 22*a* is exposed outside the engaging portion 21*a*, which is further provided with 4 arced projections 222*a*, and a top end of the connecting member 22*a* is provided with a ratchet 221*a* therearound. Since the connecting member 22*a* and the engaging portion 21*a* is separated by a spacing C whose length is equal to the thickness of the wall of the flange A1, the connecting member 22*a* of the mount 20*a* can go through the main body 10 whereby the projections 222*a* at the top end of the connecting member 22*a* will engage mutually, and, at the same time, the ratchet 221*a* surrounding the connecting member 22*a* will engage with the flexible piece 16 of the main body 10.

Figure 11:
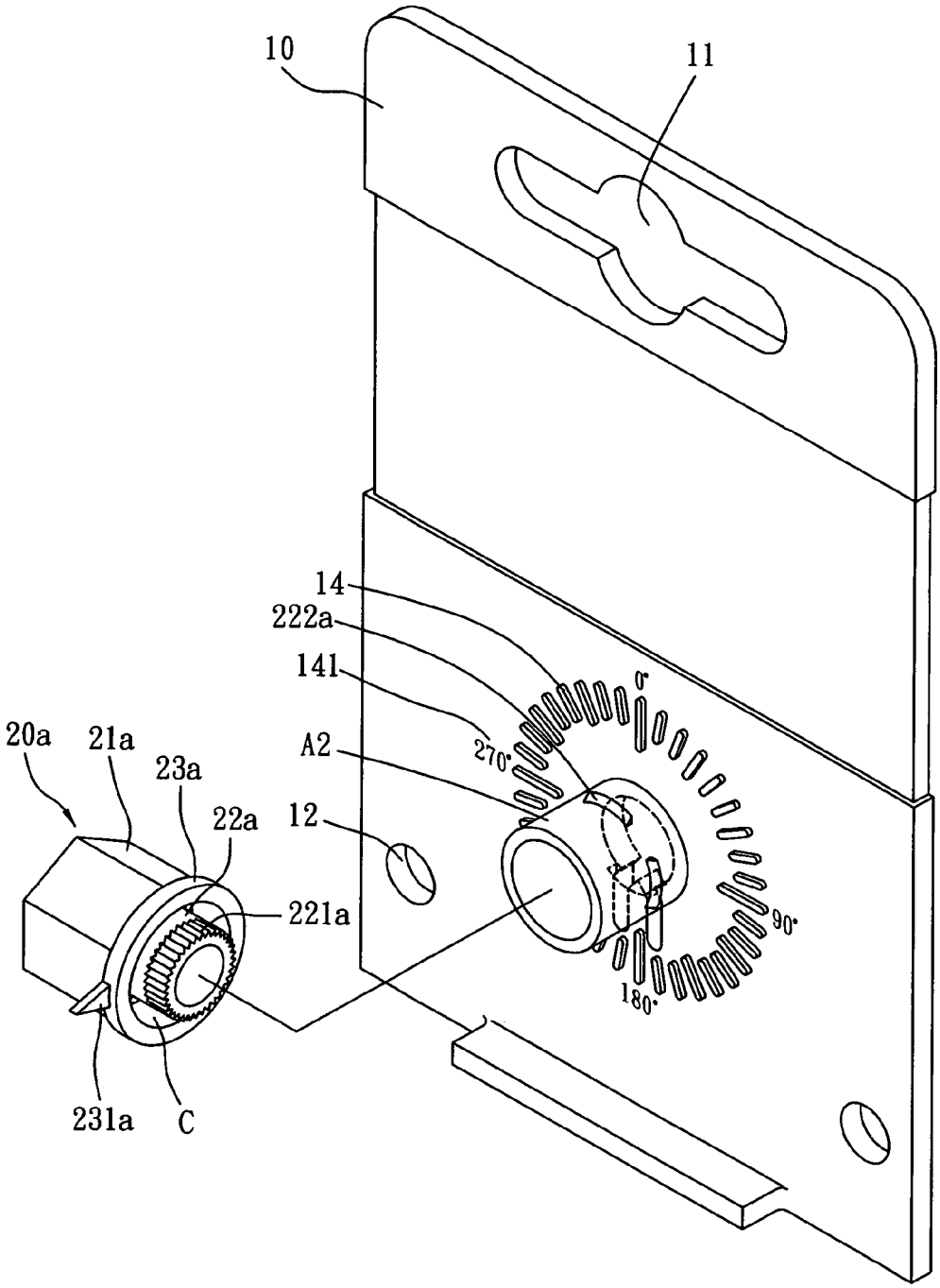
FIG. 11 is an exploded perspective view of the third preferred embodiment of the present invention as a display bracket for a wrench.
Figure 12:
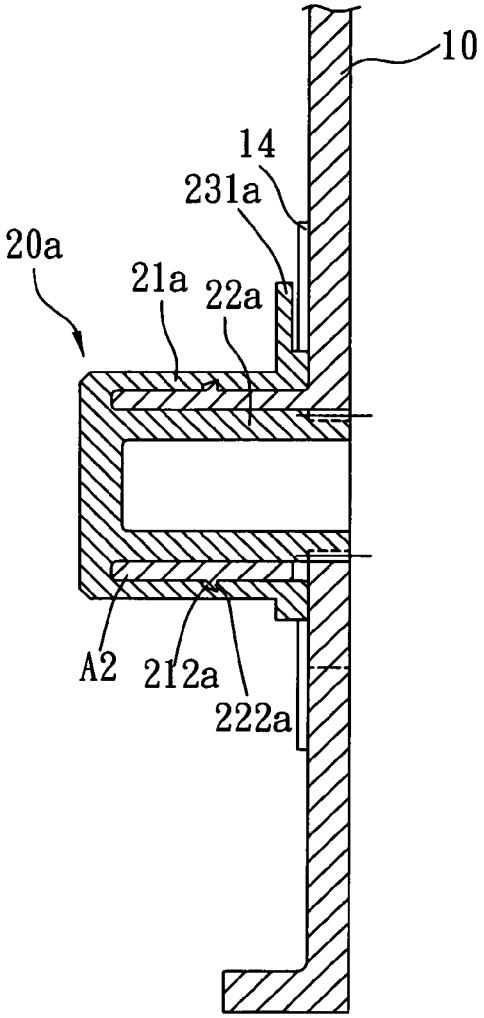
FIG. 12 is a lateral cross-sectional view of the third preferred embodiment in FIG. 11, wherein the mount and the min body are engaged.
Figure 13:
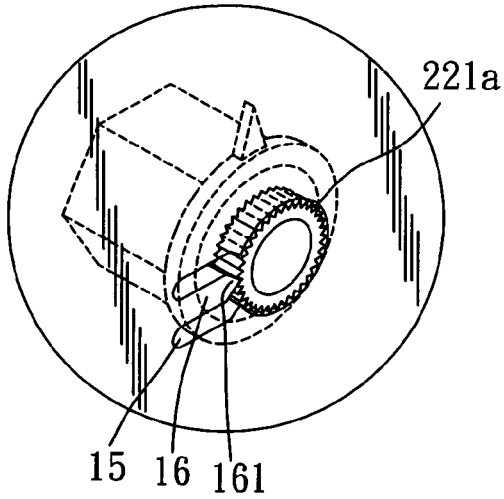
FIG. 13 is a perspective view of a local enlarged portion of the third preferred embodiment in FIG. 11, wherein the mount is engaged within the locking hole on the main body.

Referring to FIGS. 11 to 13, the third preferred embodiment of the present invention as a display bracket for a wrench has similar components to the second preferred embodiment. They differs in that the projections 222*a* at the bottom end of the connecting member 22*a* of the mount 20*a* are replaced by a corresponding flange A2. The flange A2 is locked by at least a ladder-shaped limiting notch carved on the inner wall of the engaging portion 21*a*, whereby the mount 20*a* and the main body 10 are engaged, and whereby the ratchet 221*a* of the connecting member 22*a* and the flexible piece 16 of the main body 10 are engaged.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A display bracket for a wrench, comprising:

a main body being a planar slab having a front side, a rear side and a locking hole going through said main body at a predetermined location thereon, said locking hole further including a pair of symmetric, parallel slots of predetermined depth in a horizontal direction straddling said locking hole on said main body, a flexible piece being formed between said symmetric slots and including a pointed portion formed on the top thereof; and a mount capable of being connected to said locking hole, said mount consisting of an engaging portion with a polygonal circumference and a cylindrical connecting member, whereby said connecting member will be inserted in said locking hole by the engagement between a plurality of arced projections therearound and one of said front side and said rear side of said main body, said connecting member being further secured on said locking hole by the engagement between a ratchet therearound and said flexible piece;

wherein said symmetric slots on two sides of said flexible pieces have a length substantially equal to the thickness between the front side and said rear side and a notch is cut on a side of a flange on the rear side of said main body, said flexible piece becoming an isolated body on said flange for jumping when it is urged;

wherein said ratchet being composed of a multitude of continuous oblique teeth surrounding said ratchet so that when said connecting member is inserted into said locking hole, said pointed portion of said flexible piece can be engaged with said ratchet, thereby said flexible piece will go through a transverse jump across said symmetric slots and will produce a sound by the jump of said pointed portion against said ratchet.

2. The display bracket for a wrench of claim 1 wherein said front side of said main body is provided with an indicator ring surrounding said locking hole and forms numeric indicators on the outside rim thereof; said indicator ring consisting of short, medium and long bulged, elongated pieces.

3. The display bracket for a wrench of claim 1 wherein an upper edge of said main body is further provided with a hanging hole and two retaining holes straddling said hanging hole; a retaining plate being capable of being secured within said retaining holes.

4. The display bracket for a wrench of claim 1 wherein said polygonal engaging portion and said cylindrical connecting member are divided by an externally extending dial having a pointer on an outer rim thereof for moving with the rotation of said mount.

5. The display bracket for a wrench of claim 1 wherein said arced projections around a rear terminal of said connecting member of said mount are secured with said rear side of said main body directly.

6. A display bracket for a wrench, comprising:

a main body being a planar slab having a front side, a rear side and a hollow tubular flange, said flange going through said main body to form a locking hole on said rear side thereon, said locking hole further including a pair of symmetric, parallel slots of predetermined depth in a horizontal direction straddling said locking hole on said main body, a flexible piece being formed between said symmetric slots and including a pointed portion formed on the top thereof; and a mount capable of being connected to said locking hole, said mount consisting of an engaging portion with a polygonal circumference and a cylindrical connecting member, whereby said connecting member will be inserted in said locking hole by the engagement between a plurality of arced projections therearound and one said side of said main body, said connecting member being further secured on said locking hole by the engagement between a ratchet therearound and said flexible piece;

wherein said ratchet being composed of a multitude of continuous oblique teeth surrounding said ratchet so that when said connecting member is inserted into said locking hole, said pointed portion of said flexible piece can be engaged with said ratchet, thereby said flexible piece will go through a transverse jump across said symmetric slots and will produce a sound by the jump of said pointed portion against said ratchet.

7. The display bracket for a wrench of claim 6 wherein said front side of said main body is provided with an indicator ring surrounding said locking hole and forms numeric indicators on the outside rim thereof; said indicator ring consisting of short, medium and long bulged, elongated pieces.

8. The display bracket for a wrench of claim 6 wherein an upper edge of said main body is further provided with a hanging hole and two retaining holes straddling said hanging hole; a retaining plate being capable of being secured within said retaining holes.

9. The display bracket for a wrench of claim 6 wherein said polygonal engaging portion and said cylindrical connecting member are divided by an externally extending dial having a pointer on an outer rim thereof for moving with the rotation of said mount.

10. The display bracket for a wrench of claim 6 wherein said connecting member is extended from an inner wall of said engaging portion, being located at an upper end; said connecting member and said inner wall of said engaging portion forming a predetermined spacing.

11. The display bracket for a wrench of claim 10, wherein said spacing is equal to the width of a wall of said hollow flange.

12. A display bracket for a wrench, comprising:

a main body being a planar slab having a front side, a rear side and a hollow, tubular flange whose outer surface is provided with at least one annular projection; an inner space of said flange going through said main body at a predetermined location thereon and forming a locking hole, said locking hole further including a pair of symmetric, parallel slots of predetermined depth in a horizontal direction straddling said locking hole on said main body, a flexible piece being formed between said symmetric slots and including a pointed portion formed on the top thereof; and a mount capable of being connected to said locking hole, said mount consisting of an engaging portion with a polygonal circumference and a cylindrical connecting member, whereby said connecting member will be inserted in said locking hole by the engagement between at least one limiting slot therearound and said annular projection of said flange, said connecting member being further secured on said locking hole by the engagement between a ratchet therearound and said flexible piece;

wherein said ratchet being composed of a multitude of continuous oblique teeth surrounding said ratchet so that when said connecting member is inserted into said locking hole, said pointed portion of said flexible piece can be engaged with said ratchet, thereby said flexible piece will go through a transverse jump across said symmetric slots and will produce a sound by the jump of said pointed portion against said ratchet.

13. The display bracket for a wrench of claim 12, wherein said front side of said main body is provided with an indicator ring surrounding said locking hole and forms numeric indicators on the outside rim thereof; said indicator ring consists of short, medium and long bulged, elongated pieces.

14. The display bracket for a wrench of claim 12 wherein an upper edge of said main body is further provided with a hanging hole and two retaining holes straddling said hanging hole; a retaining plate being capable of being secured within said retaining holes.

15. The display bracket for a wrench of claim 12 wherein said polygonal engaging portion and said cylindrical connecting member are divided by an externally extending dial having a pointer on an outer rim thereof for moving with the rotation of said mount.

16. The display bracket for a wrench of claim 12 wherein said connecting member is extended from an inner wall of said engaging portion, being located at an upper end; said connecting member and said inner wall of said engaging portion forming a predetermined spacing.

17. The display bracket for a wrench of claim 16 wherein said spacing is equal to the width of a wall of said hollow flange.

* * * * *